United States Patent [19]

Buschor

[11] 4,448,821

[45] May 15, 1984

[54] SPRAY COATING SYSTEM

[75] Inventor: Karl Buschor, St. Gall, Switzerland

[73] Assignee: Ransburg-Gema AB, Switzerland

[21] Appl. No.: 447,309

[22] Filed: Dec. 6, 1982

[30] Foreign Application Priority Data

Dec. 8, 1981 [DE] Fed. Rep. of Germany ..... 3148541

[51] Int. Cl.[3] ..... B05D 1/02; B05B 12/02

[52] U.S. Cl. ..... 427/424; 118/676; 118/679; 118/680; 118/682; 118/697; 118/323; 118/324

[58] Field of Search ..... 427/424; 118/676, 679, 118/680, 682, 697, 323, 324

[56] References Cited

U.S. PATENT DOCUMENTS 3,593,308 7/1971 Fagan ..... 118/679
3,646,521 2/1972 Porter ..... 118/679 X
4,278,046 7/1981 Clarke ..... 118/697 X
4,357,900 11/1982 Buschor ..... 118/679

*Primary Examiner*—Shrive P. Beck
*Attorney, Agent, or Firm*—Ostrolenk, Faber, Gerb & Soffen

[57] ABSTRACT

A spray coating system for spray coating articles as they move through a spray-coating region is disclosed. The system includes a conveyor for sequentially transporting a plurality of articles through the spray-coating region along a first path. A sprayer applies a spray coating to each article as it is transported through the spray-coating region. The sprayer is movable along a second path which runs parallel to the first path. A control circuit controls the movement of the sprayer along the second path as a function of the difference between the actual and desired instantaneous positions of the sprayer.

20 Claims, 6 Drawing Figures

SPRAY COATING SYSTEM

BACKGROUND OF THE INVENTION

The present invention relates to a spray coating system including a method and apparatus for controlling the spraying of articles by an automatically controlled sprayer as those articles are carried by a conveyor through a spray area.

In such a system, a spray control circuit turns the sprayer on and off at the correct moments and moves it through the spray area in synchronism with the article to be sprayed. In typical prior art systems, the control circuit may also determine the amount of coating material sprayed per unit of time and may control a device that charges the coating material electrostatically. Such control systems advantageously incorporate a freely programmable microprocessor with a memory that will store various programs for different coating procedures. Exemplary of such systems are British Pat. No. 2,013,934 and U.S. Pat. No. 4,357,900.

In order for the system to properly synchronize the operation of the sprayer with the movement of the article to be coated, it must know the position of the article as it moves through the spraying chamber. To this end, the system typically receives timing signals indicative of the speed of movement of the article through the spray area. The timing signals are typically generated by using a pulse generator which generates pulses in response to the motion of the conveyor at a point remote from the spray area. If an initial position of the article is known, and if the length of the conveyor remains constant, these pulses will provide an accurate indication of the instantaneous position of the article to be sprayed as it is moved through the spray area.

The initial position of the article is normally determined using an edge detector which senses the front edge of the article at a predetermined position upstream of the spray chamber. Since the movement of the conveyor will not always be smooth, the article to be painted often swings back and forth. If the article is swinging forward as it approaches the front edge detector, the detector will generate an output signal before the article has reached the desired initial position. If the article is swinging backward at the time it approaches the front edge detector, the front edge detector will generate an output signal after the article reaches the desired position. This can create differences between the actual position of the article as it is moved through the spray area by the conveyor and an apparent position of the article determined by the timing signals.

In addition to these errors, differences in tolerance, especially those created by the longitudinal expansion of the conveyor, will cause alterations in the dimensions of sections of the conveyor. This will also create differences between the actual position of an article as it moved through the spray area by the conveyor and an apparent position of the article determined by the timing signals. Such differences in actual and apparent positions will give rise to errors in the process by which the operation of the sprayer is synchronized with the movement of the article through the spray area. As a result, coating material may be sprayed to one side of the article, areas of the article which should be coated may be missed, etc.

Conveyors employed in conjunction with known spray-coating systems travel at a rate of approximately 6 meters per minute. When using a microprocessor based control circuit to control the operation of the sprayer, approximately 100 ms must be provided for the microprocessor to process a single control step and to prepare to accept a new control step. Therefore, the control circuit can only respond to timing signals (indicative of the speed of the conveyor) having a frequency of no more than about 600 signals per minute.

To allow for some margin of error at 6 meters per minute and to permit operation at a conveyor rate as high as 12 meters per minute, one timing signal should be produced for every two centimeters of conveyor travel. Fewer timing signals per section of conveyor travel would provide too low a resolution to permit accurate coating of the articles because alterations in the coating process could not take place accurately enough with respect to the time taken for the articles to move through the spray area. While it is possible to generate timing signals at high rates in response to the motion of the conveyor or the means for driving the conveyor (i.e. a drive motor) to provide high resolution information concerning the speed at which an article is moving through the spray area, the rate of such signals is too high to be utilized by a microprocessor based control circuit.

As the article is moved by the conveyor through the spray-coating region, the movement of the sprayer must be accurately controlled to be coordinated with the movement of the article to be sprayed. In certain instances, it is desirable for the sprayer to move at the same speed as the article to be coated; it is sometimes desirable for it to move at a greater or lesser speed than the article to be coated and it is sometimes desirable to keep the sprayer stationary while the article moves past it. In all cases, accurate control of the movement of the sprayer is necessary. This has not always been possible with prior art systems.

SUMMARY OF THE INVENTION

The present invention is intended to insure that the operation of an automatic sprayer is accurately synchronized with the actual movement of the article through a spray-coating region.

According to the invention, articles to be coated are sequentially transported along a first path through a spray-coating region by a conveyor. A sprayer applies spray coating to each article as it is transported through the spray-coating region, the sprayer being movable along a second path which runs parallel to the first path and which extends from a first position to a second position downstream of the first position. A position signal is generated and indicates the desired instantaneous position of the sprayer along the second path. The movement of the sprayer is controlled as a function of the difference between the actual and desired positions of the sprayer.

In the presently preferred embodiment, the position signal is generated by a programmed computer as a function of a stored spraying sequence particular to the type of article to be sprayed. Coding members and detecting means may be provided to determine the type of article that is next to be sprayed in the spray-coating region. The microprocessor then generates the position signals in accordance with the particular spraying sequence which is stored for that type of article and as a function of timing signals indicative of the rate of movement of the article through the spray-coating region.

According to another feature of the invention, a plurality of support members are located at spaced locations along the conveyor. Each support member is adapted to receive, at the option of the user of the system, a single member to be sprayed whereby each support member may, or may not, have a member to be sprayed associated with it. A start signal is generated whenever a support member having an article associated with it reaches an initial position upstream of the spray coating region. Conveyor movement pulses having a frequency representative of the speed of the conveyor are also generated. Each article is spray coated as it moves through the coating region in a manner determined both by the start signals and the conveyor movement pulses.

According to the preferred embodiment of the invention, a timing signal generating circuit generates timing signals in accordance with the frequency of conveyor movement pulses which are indicative of the speed of movement by the conveyor at a point which is remote from the spray-coating region. Since these pulses will not accurately reflect the position of the article as it is moved through the spray-coating region when the length of individual conveyor sections vary, the phase of the timing signals is periodically adjusted to reflect the actual position of the article. This is accomplished by adjusting the phase of the timing signals as a function of bracket position signals which are generated in response to the movement of successive brackets past a predetermined location along the conveyor path.

A plurality of support members, preferably brackets, are mounted at nomimally equal intervals along the conveyor. Each of the articles to be spray coated is carried by a hanger which is suspended from a bracket. Bracket detection means are provided to detect the presence of one of the brackets at the above mentioned predetermined point along the path and for producing a bracket position signal in response thereto. As described above, the pulse generating means generates conveyor movement pulses in synchronization with the speed of movement of the conveyor. These pulses are supplied to a timing signal generating circuit for producing timing signals (preferably pulses) at a frequency equal to a fraction of the frequency of the conveyor movement pulses and in synchronism with those pulses. In the preferred embodiment, the timing signal generator means produces a timing signal whenever a first predetermined number of the conveyor movement pulses have been generated. Once a second predetermined number of timing signals (preferably corresponding to one less than the number of timing signals which correspond to the nominal distance between brackets) have been generated, the further generation of timing signals is inhibited until the bracket detector means generates another bracket position signal. The timing signal generator means responds to the bracket position signal by generating another timing signal and reinitiating the counting of conveyor movement pulses. In this manner, the phase of the timing signals are adjusted to reflect the actual position of the article as it moves through the spray area. The timing signals are applied to a spray control means which operates the automatic sprayer in response thereto.

In accordance with an additional feature of the invention, coding members which are spatially associated with the brackets on the conveyor, for example, by being affixed to the hangers, are provided. These members may contain information identifying the nature of the article that is hung from the hanger. Code member detecting means detect the coding members and provide a signal to the control circuit which is indicative of the information on the code members. The control means then selects an appropriate sprayer operation for the type of article detected.

BRIEF DESCRIPTION OF THE DRAWINGS

For the purposes of illustrating the invention, there is shown in the drawings an embodiment which is presently preferred, it being understood, however, that the invention is not limited to the precise arrangement and instrumentalities shown.

DETAILED DESCRIPTION OF THE DRAWINGS

Figure 1:
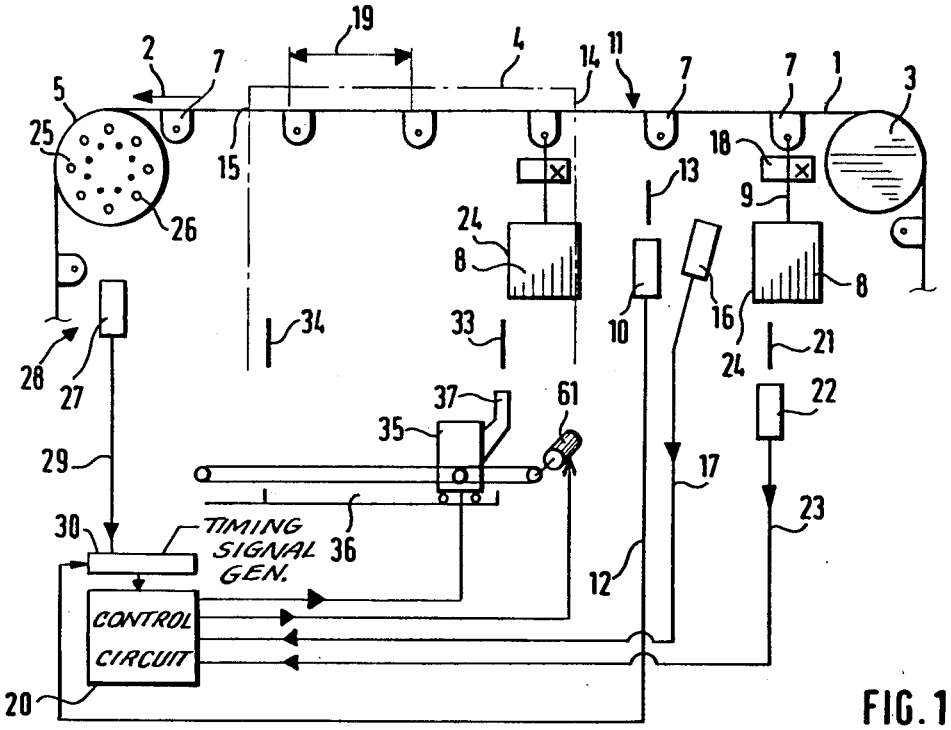
FIG. 1 is a schematic diagram of a spray-coating system in accordance with the invention there being no difference in the nominal and actual positions along the path of the conveyor of the articles to be sprayed.

Referring now to the drawings wherein like numerals indicate like elements, there is shown in FIG. 1 a continuous chain conveyor 1 which moves in the direction indicated by arrow 2 from a guide cogwheel 3 through a spray booth 4 and then over a driving cogwheel 5. While a chain conveyor is shown, a cable or roller type or any other suitable structure may also be used. Brackets 7 serve both as support elements for the hangers 9 and as position elements which are indicative of the length of individual sections of the chain. In the following description, the brackets 7 serve these dual purposes. If desired, however, brackets 7 can be used only to support hangers 9, and additional position elements, having a predetermined spacial relationship to brackets 7, can be used. Articles 8 to be coated are suspended from brackets 7 by hangers 9. A bracket sensor 10 generates a bracket position signal, preferably a pulse, on its output line 12 whenever a bracket 7 arrives at a predetermined bracket position 13 along the length of the path of conveyor 1 upstream of the entrance 14 to spray booth 4.

A detector 16, which is also upstream of the entrance 14 to the spray booth 4, generates an article identification signal at its output line 17 whenever it detects a code contained on the code plate 18 and providing information (e.g. size, shape, color to be sprayed, etc.) regarding the article 8 associated with the code plate. The article detection signal identifies the type of article 8 to be sprayed as a function of the information contained on code plate 18. The signal on output line 17 is supplied to a control circuit 20 which is preferably microprocessor based. The signal determines which of several spray control programs are used to control the spraying of articles 8, as will be described below.

In order to determine when the front edge 24 of an article 8 has reached the initial coating position 33, the system includes means for determining when a hanger 7 having an article 8 to be coated suspended therefrom reaches an initial position 21 upstream of the entrance 14 to booth 4. In the presently preferred embodiment, this means includes both the bracket sensor 10 and an article detector 22. The article detector 22 is located at the starting point 21 and produces an article detection signal on its output line 23 whenever an article 8 is at the starting position 21. Since the brackets 7 are not only at equal spaced locations, bracket sensor 10 will generate a bracket position signal on its output line 12 when a bracket 7 associated with an article 8 to be sprayed reaches the start position 21. As will be described in further detail below, control circuit 20 initiates a counting sequence whenever it has received both a bracket position signal and an article detection signal from bracket sensor 10 and article detector 22, respectively. Control circuit 20 will then count a number of timing signals correponding to the time it takes the front edge of the article 8 to be sprayed to move from the start position 21 to the initial coating position 33. The number of timing signals to be counted is determined by the size of the article 8, which size is indicated by the information on coding plate 18. After counting the predetermined number of timing signals, control circuit 20 knows that the front edge 24 of the article 8 has reached the initial coating position 33 and thereby initiates a spray coating operation.

A perforated disk 25 is coupled to driving cogwheel 5 of conveyor 1. Disk 25 is perforated, for example, with an outer ring of 2000 openings or holes 26 that are detected by a detector 27. Perforated disk 25 works in conjunction with detector 27 as a conveyor movement pulse generating means 28 that produces pulses on its output line 29. These pulses are indicative of the linear speed of the conveyor 1 at the location of cogwheel 5 and are applied to a timing signal generating circuit 30, one pulse being generated whenever one of the openings 26 arrives in the field of detector 27. Perforated disk 25 may rotate, for example, once for every one meter of travel of conveyor 1.

Presuming that the distance 19 between two successive brackets 7 is nominally twenty centimeters long, detector 27 will produce 400 pulses during the time it takes two consecutive brackets 7 to pass a stationary point (assuming that the conveyor 1 has not stretched). Timing signal generating circuit 30 (described below with reference to FIG. 5) counts the pulses from detector 27 and produces a timing signal each time a predetermined number of conveyor movement pulses are counted. These timing signals are supplied to control circuit 20 which utilizes them to control a sprayer 35 to coat articles 8. While any known control circuit may be used, one presently preferred embodiment is illustrated schematically in FIG. 6. As shown therein, control circuit 20 includes a programmable counter 202, a microprocessor 204, a spray rate control circuit 206 and a spray movement control circuit 208.

In the embodiment illustrated, control circuit 20 controls the operation of sprayer 35 by initiating a spray-coating operation when the front edge of article 8 reaches the initial coating position 33 and varies the spray-coating operation in a manner determined by the type of article to be sprayed until the front end of the article 8 reaches the final coating position 34 at which time the spray-coating operation is completed. During movement of the article 8 between positions 33 and 34, the control circuit 20 varies the amount of spray-coating material being sprayed and/or the position of sprayer 35 with respect to the article 8. As will be apparent to those skilled in the art, the control circuit 20 can control the operation of sprayer 25 in any desired manner.

The amount of coating material to be sprayed is varied by spray rate control circuit 206 which receives appropriate control signals from microprocessor 204. One control circuit for carrying out this operation is disclosed in U.S. Pat. No. 4,357,900, whose disclosure is incorporated herein by reference. In accordance with the control circuit disclosed therein, microprocessor 204 memorizes a spray-coating sequence for the given article to be sprayed (the particular article to be sprayed being identified by the article identification signal generated by sensor 16) and applies appropriate control signals to spray rate control circuit 206. These signals will cause control circuit 206 to vary the amount of coating material sprayed as a function of the movement of article 8 through spray booth 4.

The movement of sprayer 35 is controlled by sprayer movement control circuit 208 which may take the form of a programmable counter, for example, a M236 UP/-DOWN counter manufactured by Digital Corp. Sprayer movement control circuit 208 receives appropriate control signals from microprocessor 204 as the article 8 is moved between positions 33 and 34. The sprayer 35 may be moved in unison with the article 8, may be moved faster than the article 8 or may be moved slower than the article 8. The sprayer 35 may also be kept stationary.

Figure 6:
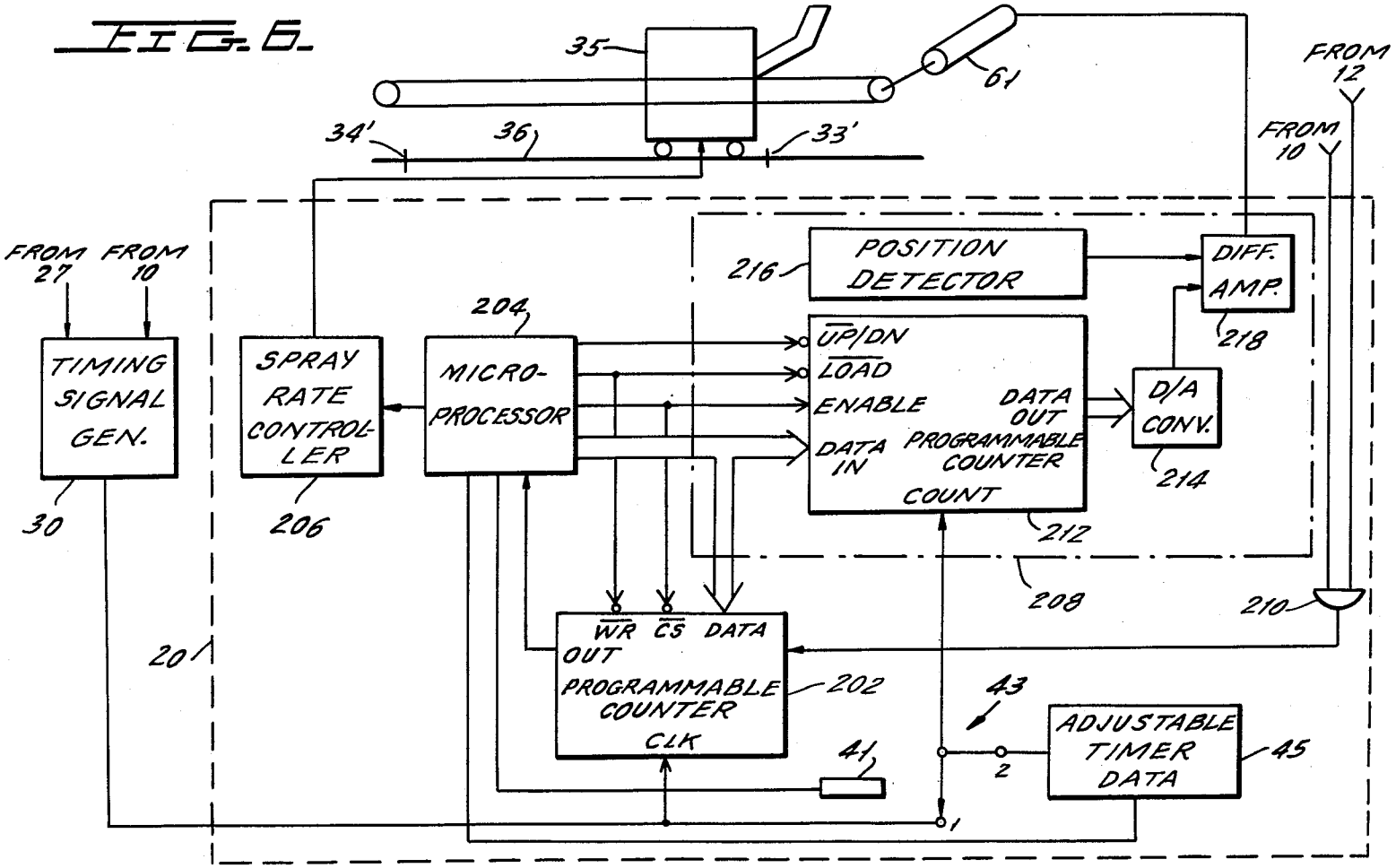
FIG. 6 is a block diagram of the control circuit of FIGS. 1 and 2.

In the embodiment of the invention illustrated in FIG. 6, sprayer movement control circuit 208 includes a programmable counter 212, a digital to analog converter 214, a position detector 216 and a difference amplifier 218. Programmable counter 212, which may be an M236 UP/DOWN counter manufactured by Digital Corp., receives various control signals from microprocessor 204 and generates a binary number on its DATA OUT output which provides a digital signal indicative of the desired position of sprayer 35. Sprayer 35 is movable along a path 36 which runs parallel to the path of movement of the articles 8 through the spray chamber 14 between a first position 33' and a second position 34' which corresponds to positions 33 and 34, respectively, of the articles 8. The binary signal appearing at the DATA OUT output of programmable counter 212 indicates the desired position along path 36 at which the sprayer 35 is to be located. The output of programmable counter 212 is applied to digital to analog converter 214 which applies an analog signal, corresponding to the digital signal at its input, to the inverting input of difference amplifier 218.

The non-inverting input of difference amplifier 218 receives the analog output of position detector 216. Position detector 216 may take any desired form and generates an analog output signal indicative of the actual position of sprayer 35. By way of example, the position detector 216 may be a potentiometer extending along the entire length of path 36. A member extending from the sprayer 35 can operate as the slide arm of the potentiometer. As the sprayer 35 is moved from the initial position 33' to the final position 34', the output of the potentiometer will vary between, for example, 0 and 100 volts. In such a case, the output of digital to analog converter 214 will also vary between 0 and 100 volts such that there is a one-to-one correspondence between the magnitude of the voltage output of digital to analog converter 214 which indicates the desired position of sprayer 35 and the magnitude of the analog output of position detector 216 which indicates the actual position of sprayer 35.

Difference amplifier 218 compares the desired position signal appearing at the output of digital to analog converter 214 to the actual position signal appearing at the output of position detector 216 and generates an error signal ΔP at its output indicative of the difference between these two signals. This signal is applied to the input of a DC armature motor 61 whose output speed and direction is determined by the magnitude and polarity, respectively, of the error signal ΔP. If there is a large difference between the actual and desired positions of sprayer 34, motor 61 will move sprayer 35 at a fairly high speed towards the desired position. As sprayer 35 gets closer to the desired position, it will gradually slow down until it reaches the desired position. In this manner, sprayer moving control circuit 208 causes the actual position of sprayer 35 to closely follow the desired position of the sprayer as indicated by the output of digital to analog converter 214.

The output of digital to analog converter 214 is determined by the output of programmable counter 212 whose output, in turn, is controlled by microprocessor 201. Microprocessor 204 will apply control signals to programmable counter 212 which determine its operation and thereby determine the value of the desired position signal.

In the simplest mode of operation, sprayer movement control circuit 208 will cause the sprayer 35 to move synchronously with the article 8 as the article 8 moves between positions 33 and 34. In such a case, microprocessor 204 will initially load the count of 0 into programmable counter 212 by placing the binary number "0" on the DATA IN input of counter 212 and by placing the $\overline{\text{LOAD}}$ input of counter 212 at the binary "0" level. This will be performed before the leading edge 24 of the article 8 reaches the initial coating position 33. Microprocessor 204 will also place a binary "0" on the $\overline{\text{UP}}$/DOWN input of counter 212 (causing the counter to count up each time it receives a pulse on its COUNT input). When the leading edge 24 of the article 8 reaches the initial coating position 33, microprocessor 204 places a binary "1" on the ENABLE input causing the count in counter 212 to increase by one each time it receives a pulse on its COUNT input. When the sprayer 35 is to move synchronously with the article 8, the timing signals appearing at the output of timing signal generator 30 are applied to the COUNT input of microprocessor 212. The count in counter 212 will continue to increase synchronously with the movement of the article 8 until the sprayer 35 reaches the final position 34'. At this point, microprocessor 204 will reset the count in counter 212 to the binary "0" level with the result that the sprayer 35 will be returned to its initial position 33'.

If sprayer 35 is to move at a speed which is different than the speed of movement of the article 8 through spray chamber 14, microprocessor 204 enables relay 41 so as to cause switch 43 to move from contact 1 to contact 2. This will cause the output of adjustable timer 45 to be applied to the count input of 212. The frequency of the pulses appearing at the output of timer 45 are determined by a binary signal generated by microprocessor 204 and applied to a DATA input of timer 45. In this manner, microprocessor 204 can cause sprayer 35 to move at various speeds relative to the movement of article 8. Sprayer 35 can also be moved back and forth relative to the movement of the article 8 by causing counter 212 to either count up or count down as desired. Additionally, the initial position of sprayer 35 can be located at any intermediate position between points 33' and 34' by merely loading the appropriate count into counter 212. This provides for extremely flexible and accurate movement of sprayer 35 relative to the movement of the article 8 through the spray chamber 14.

In the foregoing description, elements 212–218 are hardware elements which are separate from microprocessor 204. If desired, the difference signal ΔP can be generated in digital form internally of microprocessor 204 using appropriate software. The digital signal would then be converted to an analog signal in an appropriate digital to analog converter and applied to motor 61.

Before microprocessor 204 can generate the appropriate control signals which are applied to circuits 206, 208, it must know when the front edge of article 8 has reached the initial coating position 33. To this end, programmable counter 202 (which may be an Intel 8253 Programmable Internal Timer) receives the start signal generated by AND gate 210 on its GATE (enable) input, a timing signal generated by timing signal generating circuit 30 on its CLOCK input, and a binary signal generated by microprocessor 204 on its DATA input. The start signal indicates that the bracket 7 from which the next article 8 to be coated is suspended has reached the starting point 21. The timing signal indicates the speed of article 8, and the binary signal indicates the number of timing signals which must be generated by timing signal generating circuit 30 for the front edge 24 of the article 8 to reach the initial coating position 33 from the time the bracket 7 from which the next article 8 to be coated is suspended reaches the start position 21. Microprocessor 204 determines the number of timing signals which must be counted as a function of the size of the article 8 as indicated by the coding plate 18. Whenever a new article 8 to be coated reaches the start position 21, programmable counter 202 is preset to the number determined by microprocessor 204. This is done by placing the appropriate number on the DATA input of counter 202 and placing a binary 0 on the $\overline{\text{WR}}$ input of counter 202.

Whenever a bracket 7 having an article 8 to be coated suspended therefrom reaches the start position 21, both inputs to AND gate 210 will be high and AND gate 210 will generate the start signal which is applied to the GATE input of counter 202. In response to this signal, the count in counter 202 is decremented by one each time timing signal generating circuit 30 generates a new timing signal. When the predetermined number of timing signals have been generated, the OUT output of counter 202 will be enabled thereby indicating to microprocessor 204 that the front edge 24 of the article 8 has reached the initial coating position 33.

As should be made clear by the foregoing, the proper operation of sprayer control circuit 20 is dependent upon the accuracy with which the timing signals generated by timing signal generating circuit 30 indicate the actual position of the article 8 as it moves between starting position 21 and the final coating position 34. If the timing signals do not reflect the actual movement of the article 8 between these points, spray control circuit 20 may initiate a spraying operation either too soon or too late or may vary the spraying operation (e.g. the amount of coating being sprayed or the movement of sprayer 35 or its spray gun 37) in a manner which is out of synchronism with the actual movement of article 8.

To ensure that the timing signals accurately reflect the position of the article 8 as it moves through the spray booth 4, timing signal generator 30 generates the timing signals as a function of both the conveyor movement pulses generated by pulse generating means 28 and the bracket position pulses generated by bracket sensor 10. To this end, timing signal generating circuit 30 counts the conveyor movement pulses from detector 27 and produces a timing signal each time a first predetermined number of conveyor movement pulses are counted until a second predetermined number of timing signals have been generated. Circuit 30 then generates a new timing signal and reinitiates its counting operation upon receipt of the next bracket position pulse.

In the example being considered, circuit 30 will generate a single timing signal each time it counts 40 conveyor movement pulses generated by sensor 27. Since there are 2,000 openings 26 in perforated disk 25, and perforated disk 25 completes one revolution each time conveyor 1 moves one meter along the direction of arrow 2, timing signal generator circuit 30 will generate a single timing signal each time conveyor 1 nominally moves two centimeters. Presuming that each bracket 7 is nominally separated by a distance 19 of, for example, 20 centimeters apart, timing signal generating circuit 30 will generate ten timing signals in the time it takes two successive brackets 7 to pass a stationary point (e.g. position 13).

Figure 2:
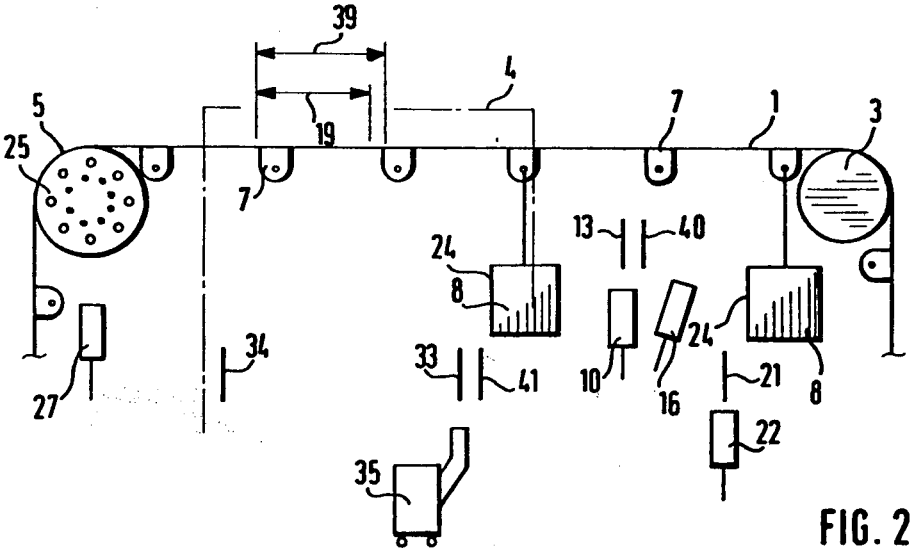
FIG. 2 is a diagram of a portion of the spray-coating system in FIG. 1 where the length of the conveyor has been altered as the result of extension or expansion, so that differences exist in the nominal and actual positions along the path of the conveyor of articles to be sprayed.

Assuming that there are no variations in the length of conveyor 1, the timing signals generated by timing signal generating circuit 30 will provide an accurate indication of the position of the article 8 as it moves through the spray booth 4. Due to variations in the weight load on conveyor 1, variations in the amount of coating material being placed on articles 8, and other variables, the conveyor 1 will often stretch causing the distance between two successive brackets 7 to increase from the nominal value. As shown in FIG. 2, the actual distance between two successive brackets 7 may stretch to a distance 39 from the nominal distance 19. As a result of this variation in the length of conveyor 1, the timing signals generated by timing signal generating circuit 30 will not, in the absence of some modification thereof, truly reflect the movement of an article 8 between the positions 21 and 34. In order to periodically modify the generation of the timing signals to truly reflect the position of the articles 8, timing signal generating circuit 30 also receives the bracket position signals generated by sensor 10. Since these signals provide information regarding variations in the length of individual sections of the conveyor 1, they can be used by timing signal generating circuit 30 to modify the phase of the timing signals generated thereby. Since the bracket position signals are generated at too low a frequency to permit accurate variations in the coating process as the article 8 is moved between positions 33 and 34, they cannot be used alone as inputs to control circuit 20. By using these signals, however, to periodically modify the phase of the high frequency timing signals generated by timing control circuit 30 in response to the conveyor movement pulses 27, the timing signals generated by circuit 30 both accurately reflect the actual movement of articles 8 and provide high resolution (i.e. high frequency) signals which can be advantageously utilized by spray control circuit 20.

Figure 5:
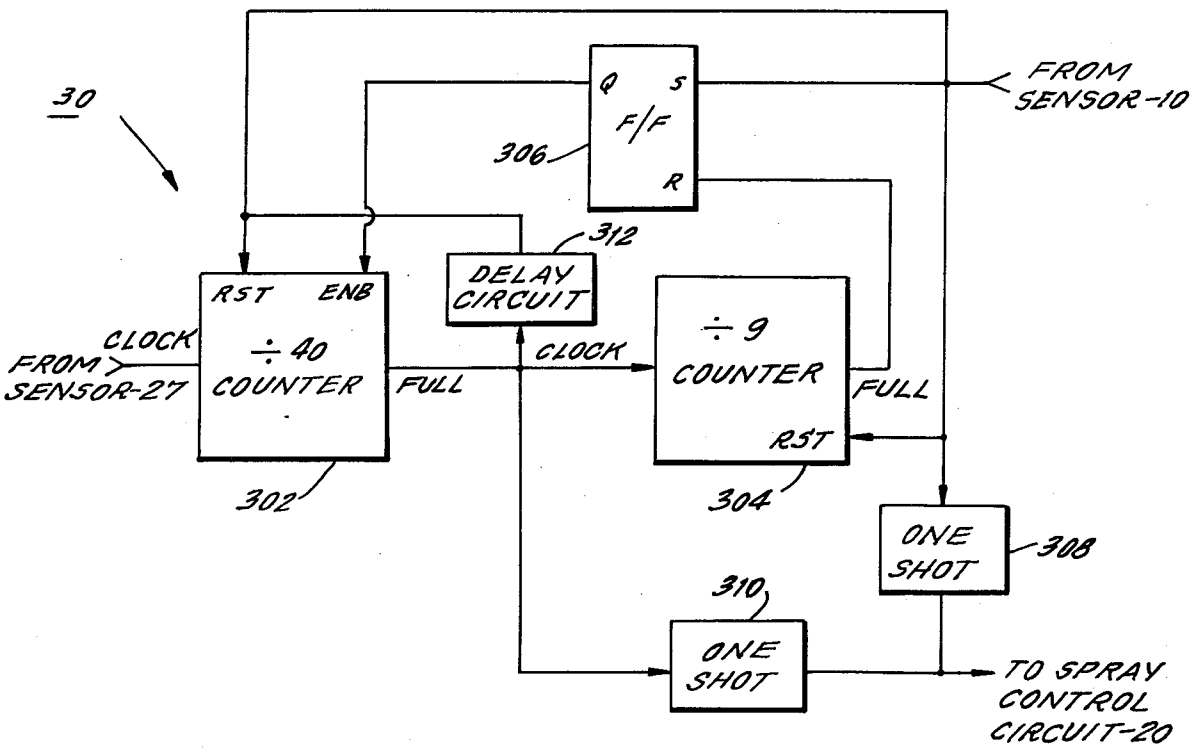
FIG. 5 is a block diagram of the control signal generating means of FIGS. 1 and 2.

One possible embodiment of timing signal generating circuit 30 is illustrated in FIG. 5. As shown therein, timing signal generating circuit 30 comprises a pair of counters 302, 304, a flip-flop 306, a pair of one-shots 308, 310 and a delay circuit 312.

Counter 302 is a divide-by-40 counter whose count is reset to zero whenever it receives a positive going pulse on its reset input RST. Since the reset input RST of counter 302 is connected to the output of bracket sensor 10, the counting counter 302 will be reset to zero whenever sensor 10 detects the presence of a bracket 7 at bracket position 13.

Once counter 302 has been reset to zero, its stored count will be increased by one each time it receives a positive going pulse on its CLOCK input. Since the CLOCK input of counter 302 is connected to the output of detector 27, this count will increase by one each time conveyor 1 nominally moves one millimeter. When the count in counter 302 reaches 40, it generates a binary 1 on its FULL output indicating that the conveyor 1 is nominally moved two centimeters. This signal is applied to the CLOCK input of counter 304, to one-shot 310 and to delay circuit 312. This signal causes one-shot 310 to generate a single timing signal, causes the count in counter 304 to increase by one and causes delay circuit 312 to reset the count in counter 302 to zero after a delay period which is shorter than the period of the pulses generated by sensor 27. At this point, counter 302 will count the pulses generated by sensor 27 so as to repeat the foregoing operation. Counter 302 will continue to operate in this manner as long as a binary 1 appears on its enable input ENB. Whenever a binary 0 appears on the enable input ENB of counter 302, counter 302 will be disabled.

Counter 304 is a divide-by-9 counter whose count is reset to zero each time a positive going pulse is applied to its reset input RST. Since the reset input RST of counter 304 is connected to the output of bracket detector 10, the count in counter 304 will be reset to zero each time a new bracket 7 reaches the bracket position 13.

Once the count in counter 304 has been set at zero, the count in counter 304 will increase by one each time it receives a positive going pulse on its CLOCK input. When the count in counter 304 reaches nine, its FULL output jumps to the binary 1 level. This signal is applied to the reset input R of flip-flop 306 causing the Q output of flip-flop 306 to toggle to the binary 0 level and thereby to disable counter 302. Counter 302 will continue to be disabled until sensor 10 detects the next bracket 7 in which time the positive going pulse generated by detector 10 will be applied to the set input S of flip-flop 306. This will cause the Q output of counter 302 to return to the binary 1 level and thereby enable counter 302. This signal also resets the count in both counters 302 and 304 so as to reinitiate operation of circuit 30. Finally, this signal is applied to one-shot 308 so as to cause the generation of another timing signal.

Summarizing the foregoing, counter 302 will cause one shot 310 to generate a timing signal each time it receives 40 pulses from sensor 27, or one timing signal for every two centimeters of nominal movement of conveyor 1. Counter 302 will continue to count pulses generated by sensor 27 until nine timing signals are generated. At that point, counter 302 is disabled until a bracket position pulse is generated by sensor 10. At that point, counter 302 will be re-enabled and the process will be repeated. In this manner, timing circuit 30 generates timing signals at a frequency corresponding to the speed of movement of conveyor 1 and adjusts the phase of these signals as a function of the actual distance between successive brackets 7 as detected by detector 10.

Figure 3:
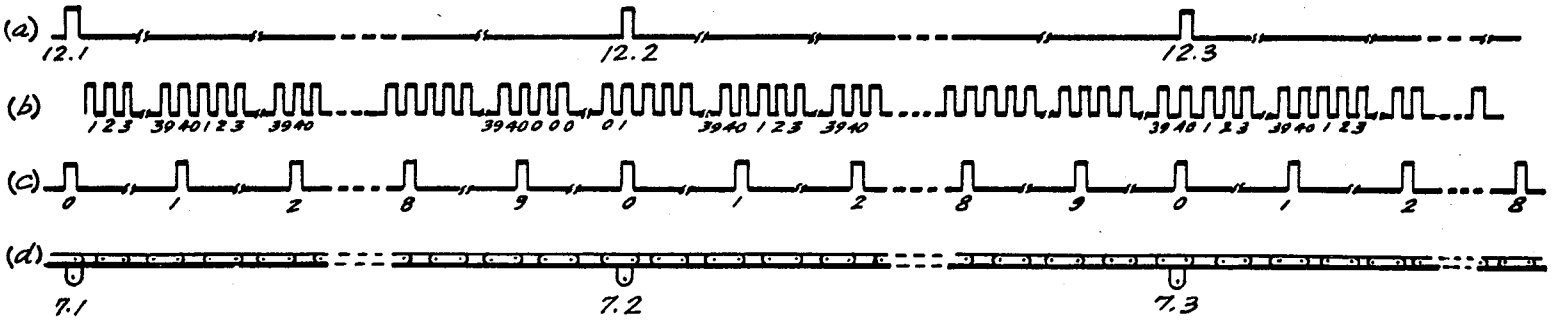
FIG. 3 is a system timing diagram of various signals generated by the system of FIG. 1.
Figure 4:
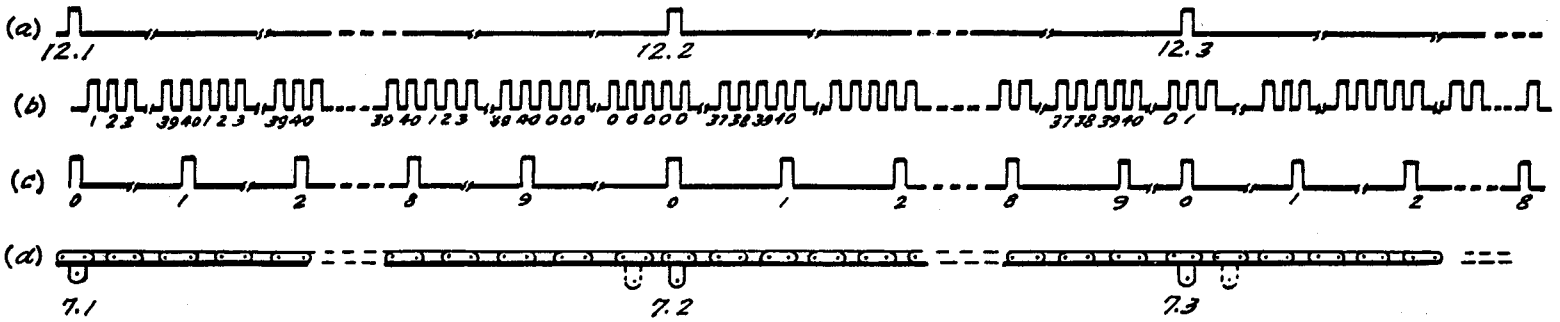
FIG. 4 is a system timing diagram of various signals generated by the system of FIG. 2.

The foregoing operation of timing circuit 30 can best be understood with reference to FIGS. 3 and 4.

FIG. 3 illustrates the timing of various signals appearing in FIG. 5, and the position of successive brackets 7 when conveyor 1 is not stretched and each of the brackets 7 is exactly 20 centimeters apart. Line A of FIG. 3 illustrates the bracket position pulses generated by detector 10 and appearing on line 12. Line B illustrates the conveyor movement pulses generated by sensor 27. The numbers below the conveyor movement pulses indicate the instantaneous count in counter 302. Line C of FIG. 3 illustrates the timing signals generated by timing signal generator circuit 30. The numbers under the pulses indicate the count in counter 304. Line D provides a schematic illustration of the position of the brackets 7 in relationship to the signals of lines A–C. In order to illustrate all of the required signals for three successive brackets, lines A–C have been broken at appropriate locations. It will be apparent to those skilled in the art that additional signals appear in the broken areas of lines B and C.

As noted above, timing signal generator circuit 30 is reset upon the generation of each conveyor movement pulse (shown as pulses 12.1, 12.2 and 12.3 in line A). Upon receipt of one of these pulses, the count in counters 302 and 304 is reset to zero. Thereafter, count in counter 302 is increased by one at a frequency determined by the conveyor movement pulses shown in line B. When the count in counter 302 reaches 40, counter 302 generates a positive going pulse on its FULL output causing one-shot 310 to generate a single timing signal (see line C) and causing the count in counter 302 to be reset to zero (see line B). At the same time, the count in counter 304 is increased to one. Thereafter, the count in counter 302 is increased by one each time it receives an additional conveyor movement pulse until the count in counter 302 reaches 40. At that point, a positive going pulse appears at the FULL output of counter 302 causing one-shot 310 to generate a second timing signal (see line C) and causes the count in counter 302 to be reset to zero (see line B). The count in counter 304 increases to two (see line C) and the foregoing operation continues until the count in counter 304 reaches nine. At that point, a positive going pulse appearing at the FULL output of counter 304 causes flip-flop 306 to disable counter 302 such that the count in counter 302 remains at zero despite the receipt of additional conveyor movement pulses (see line B). Timing circuit 30 will be reset by the next bracket position pulse 12.2 (see line A) generated by sensor 10. The entire operation is then repeated as shown.

In the illustration set forth in FIG. 3, it is assumed that the actual spacing between successive brackets 7 is exactly twenty centimeters. As such, the spacing between the ninth and tenth timing signals is the same as that between the remaining timing signals. The manner in which timing circuit 30 adjusts this relationship in the event of a stretching or contraction of conveyor 1 is illustrated in FIG. 4.

Since the distance between two successive brackets rarely varies by more than 10%, the operation of timing signal generator circuit 30 during the generation of the first nine timing signals is normally identical to that illustrated in FIG. 3. In the example illustrated in FIG. 4, it is assumed that the distance between bracket 7.1 and 7.2 has increased (the nominal position of bracket 7.2 being illustrated in phantom). As a result, the count in counter 302 remains at the zero level for a time period greater than 40 conveyor movement pulses so as to cause the phase of the tenth timing signal to be delayed with respect to the first nine timing signals. Once the bracket position signal 12.2 (see line A) has caused the generation of the tenth timing pulse (see line C), timing signal generator circuit 30 repeats its standard operation and generates nine successive timing signals at a frequency determined by the conveyor movement pulses generated by sensor 27. In the example illustrated, it is assumed that the distance between successive brackets 7.2 and 7.3 has decreased from the nominal distance (the nominal position of bracket 7.3 being shown in phantom). Accordingly, the count in counter 302 will be reset by the bracket position pulse 12.3 before the generation of 40 conveyor movement pulses. This effectively shifts the phase of the timing signals to the left as shown. See line C of FIG. 4.

In the foregoing examples, it is assumed that the spacing between successive brackets 7 never decreases by more than 10%. It should be apparent to one skilled in the art, however, that if a larger decrease does occur, this will merely cause the phase of the timing signals to be adjusted before nine full timing signals are generated and will reset the operation of timing circuit 30 at that point.

In the foregoing description, each of the elements of timing circuit 30 are hardware elements. It should be apparent to one of ordinary skill in the art that the identical function can be carried out by providing an appropriate software program to a microprocessor. Accordingly, such a modification of the described embodiment falls fully within applicant's invention.

The present invention may be embodied in other specific forms without departing from the spirit or essential attributes thereof and accordingly, reference should be made to the appended claims, rather than to the foregoing specification as indicating the scope of the invention.

What is claimed is:

1. A spray coating system for spray coating articles as they move through a spray-coating region, said system comprising:

(a) a conveyor for sequentially transporting a plurality of articles through said spray-coating region along a first path;

(b) a sprayer for applying a spray coating to each said article as it is transported through said spray-coating region, said sprayer being movable along a second path which runs parallel to said first path;

(c) position signal generating means for generating a first position signal indicative of the desired instantaneous position of said sprayer along said second path;

(d) position signal generating means for generating a second position signal indicative of the actual instantaneous position of said sprayer along said second path; and (e) means for controlling the movement of said sprayer along said second path as a function of the difference between the actual and desired positions of said sprayer as indicated by said first and second position signals, respectively.

2. The spray coating system of claim 1, wherein said position signal generating means generates said first position signal as a function of timing signals indicative of the actual speed of movement of an article to be sprayed through said spray-coating region.

3. The spray coating system of claim 1, wherein said timing signals are generated by a timing signal generator including:

(a) means for generating conveying movement pulses having a frequency representative of the speed of said conveyor, and therefore the speed of said article, as it moves through said spray-coating region;

(b) a plurality of detachable elements located at spaced locations along said conveyor;

(c) element detection means for generating an element position signal each time one of said elements passes a predetermined location whereby said element position signals provide information regarding the relative lengths of subsections of said conveyor, the location of said elements being such that the frequency of said element position signals is less than the frequency of said conveyor movement pulses; and (d) means for generating said timing signals at a frequency determined by said conveyor movement pulses and for periodically adjusting the phase of said timing signals as a function of said element position signals.

4. The spray coating system of claim 3, wherein said means for generating conveyor movement pulses comprises means for detecting the linear speed of said conveyor at a first point remote from said spray-coating region and for generating conveyor movement pulses representative thereof.

5. The spray coating system of claim 4, wherein said detecting means detects the speed of said conveyor at a point downstream from said spray-coating region.

6. The spray coating system of claim 4, wherein said detectable elements are equally spaced when said conveyor is in a non-stretched state.

7. The spray coating system of claim 1, wherein said position signal generating means generates said first position signal in a manner which causes the said sprayer to move asynchronously with respect to said article.

8. The spray coating system of claim 7, wherein said position signal generating means generates said first position signal as a function of timing pulses which are independent of the speed of movement of said article through said spray-coating region.

9. The spray coating system of claim 8, wherein said position signal generating means includes a microprocessor which determines the frequency of said timing pulses.

10. The spray coating system of claim 1, wherein said position signal generating means includes a microprocessor which determines which type of article is being moved through said spray-coating region and varies said first position signal as a function thereof.

11. The spray coating system of claim 1, further including:

(a) a plurality of support members located at spaced locations along said conveyor, each support member adapted to receive, at the option of the user of said system, a single article to be spray coated whereby each support member may, or may not, have an article to be sprayed associated with it;

(b) conveyor movement pulse generating means for generating conveyor movement pulses having a frequency representative of the speed of said conveyor, and therefore the speed of each of said articles, as it moves through said spray-coating region;

(c) start signal generating means for generating a start signal whenever a support member having an article associated with it reaches an initial position upstream of said spray-coating region; and (d) said position signal generating means generating said first position signal as a function of said start signal and said conveyor movement pulses.

12. The spray coating system of claim 11, wherein said start signal generating means comprises:

(a) means for generating a first signal whenever said support member reaches said initial position;

(b) means for generating a second signal whenever an article to be coated is associated with the support member located at said initial position; and (c) means for generating said start signal when both said first and second signals are generated.

13. The spray coating system of claim 12, wherein said first signal generating means comprises:

a plurality of detectable elements located at positions associated with said spaced locations; and means for detecting said detectable elements.

14. The spray coating system of claim 13, wherein said detectable elements are said support members and wherein said detecting means determines that a given support member is located at said initial position by detecting the fact that a support member downstream from said given support member is located at a predetermined position downstream from said initial position.

15. The spray coating system of claim 11, wherein each of said articles is swingably suspended from its associated said support member.

16. A method for spray coating articles as they move through a spray-coating region, comprising the steps of:

(a) sequentially transporting a plurality of articles through said spray-coating region along a first path;

(b) generating a first position signal indicative of the actual position of a sprayer along a second path, parallel to said first path, said sprayer spray coating each said article as said article is transported through said spray-coating region;

(c) generating a second position signal indicative of the desired instantaneous position of said sprayer along said second path; and (d) controlling the movement of said sprayer along said second path as a function of the difference between said actual and desired positions of said sprayer as indicated by said second and first position signals, respectively.

17. The method of claim 16, wherein said second position signal is generated as a function of timing signals which are indicative of the actual speed of movement of said article to be sprayed through said spray-coating region.

18. The method of claim 17, wherein said second position signal is generated in a manner which causes said sprayer asynchronously with respect to said articles.

19. The method of claim 18, wherein said second position signal is generated as a function of timing pulses which are independent of the speed of movement of said article through said spray-coating region.

20. The method of claim 16, wherein said second position signal varies in a manner determined by the specific article being transported through said spray-coating region.

* * * * *